US010851503B2

(12) United States Patent
Alberson et al.

(10) Patent No.: US 10,851,503 B2
(45) Date of Patent: Dec. 1, 2020

(54) TENSION END TREATMENT FOR GUARDRAIL SAFETY SYSTEM

(71) Applicant: The Texas A&M University System, College Station, TX (US)

(72) Inventors: Dean C. Alberson, Bryan, TX (US); D. Lance Bullard, Jr., College Station, TX (US); C. Eugene Buth, Wellborn, TX (US); Roger P. Bligh, College Station, TX (US); Akram Y. Abu-Odeh, College Station, TX (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 15/214,888

(22) Filed: Jul. 20, 2016

(65) Prior Publication Data

US 2017/0051461 A1 Feb. 23, 2017

Related U.S. Application Data

(60) Provisional application No. 62/195,006, filed on Jul. 21, 2015.

(51) Int. Cl.
*E01F 15/14* (2006.01)
*E01F 15/02* (2006.01)

(52) U.S. Cl.
CPC ..... *E01F 15/143* (2013.01); *E01F 15/025* (2013.01)

(58) Field of Classification Search
CPC ... E01F 15/025; E01F 15/0407; E01F 15/143; E01F 15/145; E01F 15/146; E01F 15/148
USPC ..... 256/13.1; 404/6, 7, 10
See application file for complete search history.

(56) References Cited

U.S. PATENT DOCUMENTS

| | | | | |
|---|---|---|---|---|
| 5,775,675 | A * | 7/1998 | Sicking | E01F 15/0476 256/13.1 |
| 6,173,943 | B1 * | 1/2001 | Welch | E01F 15/143 256/13.1 |
| 6,554,256 | B2 * | 4/2003 | Ochoa | E01F 15/143 256/13.1 |
| 6,719,483 | B1 * | 4/2004 | Welandsson | E01F 15/0476 256/13.1 |
| 6,783,116 | B2 * | 8/2004 | Albritton | E01F 15/143 256/13.1 |
| 7,694,941 | B2 * | 4/2010 | Abu-Odeh | E01F 15/143 256/13.1 |
| 8,215,619 | B2 * | 7/2012 | Leonhardt | E01F 15/025 256/13.1 |

(Continued)

*Primary Examiner* — Josh Skroupa
(74) *Attorney, Agent, or Firm* — Baker Botts L.L.P.

(57) ABSTRACT

An end treatment for a guardrail safety system includes a terminal portion of a guardrail beam comprising a downstream end and upstream end, a first tension cable coupled to an upstream end of the terminal portion. An extruder configured to receive at least a portion of the guardrail beam and at least a portion of the first tension cable, and a terminal support post installed adjacent the roadway at an upstream end of the terminal portion of the guardrail beam. The extruder includes a narrowing throat providing a channel in which at least a portion of the guardrail beam is disposed. The narrowing throat is configured to flatten the guardrail beam in response to a collision with a vehicle moving the extruder in a downstream direction along the guardrail beam. The terminal support post coupled to an upstream end of the first tension cable.

5 Claims, 12 Drawing Sheets

(56) References Cited

U.S. PATENT DOCUMENTS

| | | | | |
|---|---|---|---|---|
| 8,517,349 | B1 * | 8/2013 | Ross | E01F 15/143 256/1 |
| 8,596,617 | B2 * | 12/2013 | James | E01F 15/025 256/13.1 |
| 9,145,943 | B2 * | 9/2015 | Sicking | E01F 15/145 |
| 9,689,124 | B2 * | 6/2017 | Harman | E01F 15/143 |
| 9,714,493 | B1 * | 7/2017 | Dyke | E01F 15/0438 |
| 2003/0025112 | A1 * | 2/2003 | Sicking | E01F 15/143 256/13.1 |
| 2007/0252124 | A1 * | 11/2007 | Heimbecker | E01F 15/025 256/13.1 |
| 2012/0217459 | A1 * | 8/2012 | Smith | E01F 15/143 256/13.1 |
| 2014/0231735 | A1 * | 8/2014 | Harman | E01F 15/143 256/13.1 |

* cited by examiner

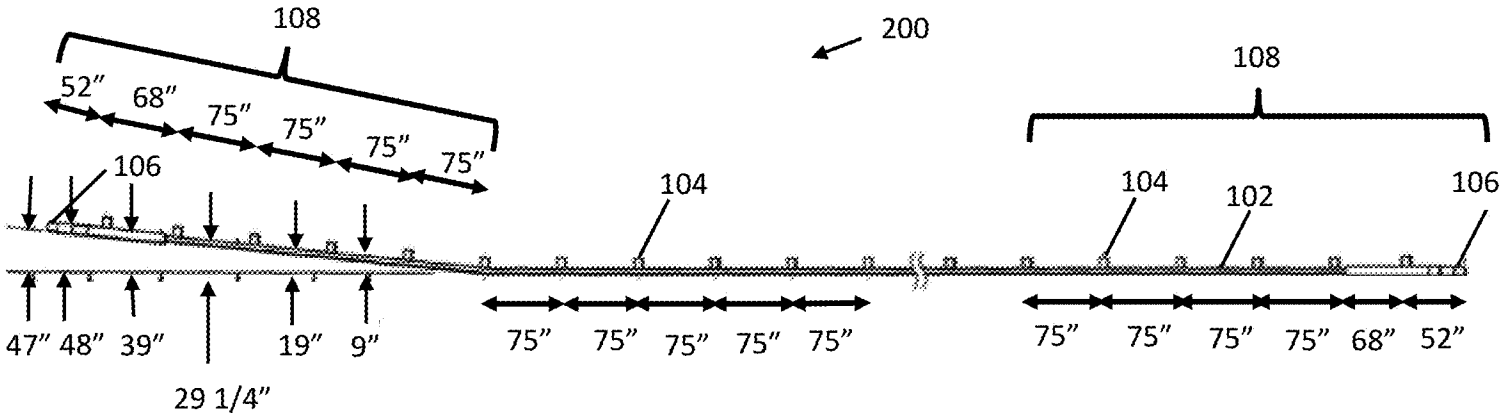
200
108
106
102
104
52"
68"
75"
75"
75

200
204
210
212
202
206
207
209

204
208
302B
302A

208

204
214

218
216
218
222
220

TENSION END TREATMENT FOR GUARDRAIL SAFETY SYSTEM

RELATED APPLICATIONS

This nonprovisional patent application claims priority to U.S. Provisional Patent Application No. 62/195,006, filed Jul. 21, 2015 and entitled "Tension End Treatment For Guardrail Safety System."

TECHNICAL FIELD

The present invention relates generally to safety end treatment for guardrail beams; and more particularly, to a tensioned end treatment for dissipating impact energy of a car colliding with the end of the guardrail beam.

BACKGROUND

Along most highways there are hazards that can be a substantial danger to drivers of automobiles if the automobiles leave the highway. To reduce the severity of accidents due to vehicles leaving a highway, guardrails are provided. The guardrails are installed such that the beam elements are in tension to aid in re-directive type impacts. Guardrails must be installed, however, such that the terminal end of the guardrail facing the flow of traffic is not a hazard. Early guardrails had no proper termination at the ends, and it was not uncommon for impacting vehicles to become impaled on the guardrail causing intense deceleration of the vehicle and severe injury to the occupants. In some reported cases, the guardrail penetrated directly, into the occupant compartment of the vehicle fatally injuring the occupants.

Upon recognition of the problem of proper guardrail termination, guardrail designs were developed that used box beams and W-beams that allow tapering of the end of the guardrail into the ground. Such designs eliminate any spearing effect. While these end treatments successfully removed the danger of the vehicle being penetrated in a head-on collision, it was discovered that these end treatments operate in a ramp-like fashion and may induce launching of the vehicle causing it to become airborne for a considerable distance with the possibility of roll over.

In search for better end treatments, improved energy absorbing end treatments for W-beam guardrail elements were developed. For example, an extruder terminal was developed and typically includes a bending structure that squeezes the guardrail into a flat plate and then bends it about a circular arc directed away from the impacting vehicle. Example extruder terminal products include the ET 2000™ and the ET-PLUS™ offered by Trinity Highway Products. Other extruder terminal products include the SKT 350™ and FLEAT 350™ offered by Road Systems, Inc.

Many of these energy absorbing systems use a cable to connect the first w-beam guardrail segment to the first post in the system. The cable provides tension in the guardrail beam element for a redirective hit along the length-of-need portion of the guardrail. A number of cable releasing posts have also been developed for use in these terminals. The cable release posts are intended to release the cable anchor and, thus, release the tension in the system when the post is impacted in either of a forward (end-on) or reverse direction. Such systems are not able to remain in tension during end-on and reverse-direction type impacts.

SUMMARY OF THE INVENTION

The present invention provides a new and improved tension end treatments for highway guardrails.

According to a particular embodiment, an end treatment for a guardrail safety system includes a terminal portion of a guardrail beam comprising a downstream end and upstream end, a first tension cable coupled to an upstream end of the terminal portion. an extruder configured to receive at least a portion of the guardrail beam and at least a portion of the first tension cable, and a terminal support post installed adjacent the roadway at an upstream end of the terminal portion of the guardrail beam. The extruder includes a narrowing throat providing a channel in which at least a portion of the guardrail beam is disposed. The narrowing throat is configured to flatten the guardrail beam in response to a collision with a vehicle moving the extruder in a downstream direction along the guardrail beam. The terminal support post coupled to an upstream end of the first tension cable.

Technical advantages of particular embodiments of the present invention include a guardrail end treatment that dissipates impact energy for deceleration of the impacting vehicle. Another advantage may be that a tensile and resistive coupling may be provided for connecting an end of the W-beam guardrail element to a terminal support post. The components of the system that provide the tensile connection of the guardrail beam to the terminal support post may enable the guardrail beam to remain secured after an end-on or re-directive impact. Thus, the system may remain in tension during both types of impacts. Still another advantage may be that the tension is released when the system is impacted in the reverse direction near the terminal end, however. The releasing of tension in the guardrail element for reverse direction impacts prevents vehicle instability and excessive deceleration Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

FIG. 1 illustrates a top view of an exemplary guardrail safety system, according to particular embodiments;

DETAILED DESCRIPTION OF EXAMPLE EMBODIMENTS

Figure 2A:
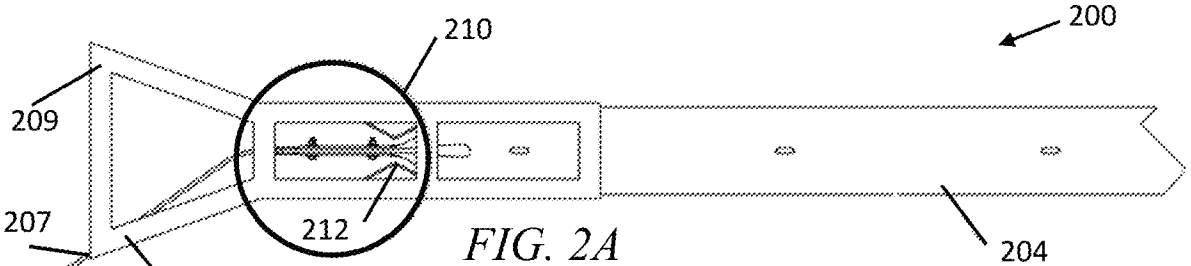
FIGS. 2A, 2B, 2C, 2D, and 2E illustrate various views of a tension end treatment having a single round cable leader, according to particular embodiments.
Figure 2B:
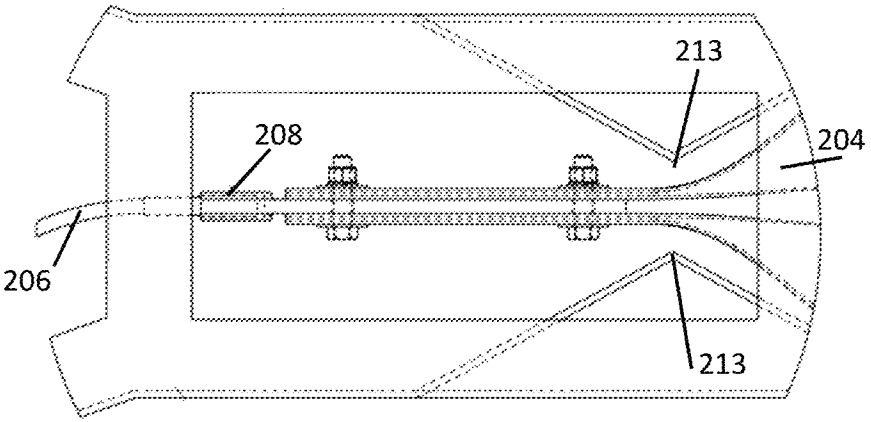
Figure 2C:
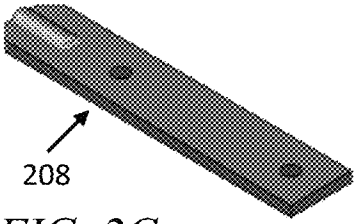

Existing guardrail end treatments have proven to be unsafe for some collision conditions that happen on the highway, sensitive to installation details, and/or very costly. However, the end treatments described below are safety treatments for the ends of a W-beam or other guardrail that provide a higher level of performance over a wider range of collision conditions and reduces end treatment costs and the number of injuries and deaths associated with guardrail terminal accidents. The described system maintains the tension in the guardrail beam element during both end-on and re-directive type impacts. When the system is impacted in the reverse direction near the terminal end, however, the anchorage system may release to prevent vehicle instability or excessive deceleration.

FIG. 1 illustrates a guardrail safety system 100 that incorporates certain aspects of the present invention. Guardrail system 100 may be installed adjacent a roadway 101, to protect vehicles, drivers and passengers from various obstacles and hazards, and prevent vehicles from leaving the roadway 101 during a traffic accident or other hazardous condition. Guardrail systems that incorporate aspects of the present invention may be used in median strips or shoulders of highways, roadways, or any path that is likely to encounter vehicular traffic.

Guardrail system 100 includes a guardrail beam 102 and support posts 104 that anchor guardrail beam 102 in place along the roadway 101. In a particular embodiment, guardrail beam 102 may include multiple 12-gauge W-beam rail elements of a length on the order of approximately 12.5 feet or 25 feet. The guardrail beam sections may be mounted at a height of on the order of approximately 27 to 31 inches with rail splices positioned mid-span between the support posts 104.

Guardrail beam 102 is attached to support posts 104 with connectors that may include, in particular embodiments, slotted countersunk bolts such as, for example, 16 mm (⅝-inch) diameter by 38 mm (1½-inch) long flat slot machine screws. Oversized guardrail nuts may be used on the back side of the support post 104. Support posts 104 may be embedded in the ground, a concrete footing, or a metal socket. Support posts 104 may be made of wood, metal, plastic, composite materials, or any combination of these or other suitable materials. It is also recognized that each support post 104 within guardrail system 100 need not necessarily be made of the same material or include the same structural features. Furthermore, the cross-section of support posts 104 may be any engineered shape suitable for releasably supporting guardrail beam 102. Such cross-sectional shapes may include, but are not limited to, square, rectangular, round, elliptical, trapezoidal, solid, hollow, closed, or open.

Guardrail system 100 is intended to keep errant vehicles from leaving roadway 101 during a crash or other hazardous situation. In many instances, guardrail 100 is installed between roadway 101 and a significant hazard to vehicles (e.g., another roadway, a bridge, cliff, etc.). Therefore, guardrail system 100 should be designed to withstand a significant impact from a direction generally perpendicular to roadway 101, without substantial failure. It is this strength that allows guardrail system 100 to withstand the impact, and still redirect the vehicle so that it is once again traveling generally in the direction of roadway 101.

However, testing and experience has continuously shown that guardrail systems may actually introduce additional hazards to the roadway and surrounding areas. This is particularly true with respect to vehicles that impact the guardrail system adjacent its terminal section, in a direction generally parallel to the roadway. For example, if the guardrail system were rigidly fixed in place during a crash, serious injury and damage may result to the errant vehicle, its driver and passengers. Accordingly, many attempts have been made to minimize this added risk. Such methods generally include the use of terminal portions that are tapered from the ground up to effectively reduce the impact of head on collisions and to create a ramp-like effect that causes vehicles to go airborne during a crash. Other methods include breakaway cable terminals (BCT), vehicle attenuating terminals (VAT), SENTRE end treatments, breakaway end terminals (BET) and the breakaway support posts of U.S. Pat. No. 6,398,192 ("'192 patent"). Many-such terminals, supports, end treatments and the like are commercially available from various organizations. Examples include the HBA post by Exodyne Technologies and Trinity Industries, and a breakaway support post similar in configuration to that described in the '192 patent.

Referring again to FIG. 1, guardrail system 100 includes one terminal post 106 and seven support posts 104. Collectively, this configuration forms a terminal section 108 of guardrail system 100. As shown, terminal section 108 is employed in a preferred embodiment as an end treatment for a conventional guardrail assembly 100.

Although FIG. 1 is illustrated with dimensions and depicts one exemplary embodiment, it is understood that the dimensions of guardrail system 100 may vary depending on the nature of the roadside hazard being shielded. As illustrated, each terminal section 108 has a length on the order of approximately 35 feet. However, the dimensions of terminal section 108 may vary as needed. Additionally, the length of the length-of-need portion of the system may of any appropriate length required by the conditions of roadway 101

Terminal section 108 may be installed either parallel to roadway 101 or at an angular departure from roadway 101, as shown best in FIG. 1. Additionally, while the terminal section 108 at one end of the guardrail safety system may be flared or straight flared, the terminal section 108 at the opposite end of the system may not be flared, in certain embodiments. For example, in the embodiment depicted in FIG. 1, an upstream terminal section 108 is flared or straight flared while a downstream terminal section 108 is not flared. Specifically, the upstream terminal sections 108 is flared or straight flared away from roadway 101 in a substantially linear manner while the downstream terminal section 108 remains substantially parallel to the roadway. In other embodiments, both terminal sections 108 may be flared or unflared in a similar manner. Additionally, it is recognized that other configurations may be used for terminal sections 108. For example, one or both of terminal sections 108 may be installed at a parabolic flare away from the roadway. A parabolic flare may be accomplished by increasing the offset of each support post in a generally parabolic progression as the terminal portion proceeds upstream. Where incorporated, positioning of one or more of terminal sections 108 at a flared, straight flared, or angular departure away from roadway 101 may permit the terminal sections 108 to perform a gating function by facilitating movement of the impacting vehicle to the side of the rail opposite roadway 101 as the vehicle progresses.

In a particular embodiment where terminal section 108 is linearly flared, terminal section 108 may be flared back at an angle of approximately 6 to 7 degrees from the non-terminal portion of the guardrail. Where support posts 104 of terminal section 108 are spaced apart at intervals of approximately 75 inches, the most downstream post 104 of terminal section 108 may be approximately 9 inches offset from a line tangent to the non-terminal portion of the guardrail, in a particular embodiment. Moving toward the upstream end of terminal section 108, the next four successive support posts 104 may be 19, 29.25, 39, and 48 inches offset from a line tangent to the non-terminal portion of the guardrail, in this embodiment. Terminal post 106, which may be positioned directly below guardrail beam 102, may be approximately 47 inches offset from a line tangent to the non-terminal portion of the guardrail, in the described embodiment.

In various embodiments, terminal section 108 includes an end treatment at either or both ends of guardrail system 100. The purpose of end treatment is to dissipate impact energy of the vehicle without creating a dangerous condition such as causing the vehicle to roll-over or allow the guardrail 102 to spear the vehicle or the occupant compartment of the vehicle. In certain embodiments, the end treatment may be designed to maintain tension in the guardrail 102 during and after impact.

FIGS. 2A, 2B, 2C, 2D, and 2E illustrate various views of a tension end treatment 200 having a single round cable leader through a snout, according to an exemplary embodiment. The tensioned end treatment includes a head 202 that couples to a slotted guardrail beam 204. Guardrail beam 204 is held in tension by tension cable 206, which attaches to a downstream end of guardrail beam 204 and exits a snout 207 and tapers to the ground. The coupling between tension cable 206 and guardrail beam 204 is affected by a paddle 208. The coupling of guardrail beam 204 to tension cable 206 enables guardrail beam 204 to remain secured in tension even after either of an end-on or re-directive impact by a vehicle leaving roadway 101. However, the components effecting the tensile coupling enables the tension in guardrail beam 204 to be released when the system is impacted in the reverse direction near the terminal end. The releasing of tension in the guardrail element for reverse direction impacts prevents vehicle instability and excessive deceleration.

End treatment 200 includes a front striking plate 209. coupled to an extruder 210. Extruder 210 surrounds the upstream portion of guardrail beam 204. In one embodiment, extruder 210 may be made up of an upper, U-shaped channel member and a lower, U-shaped channel member, which are secured in a spaced relation to one another by strap plates. The vertical distance between the channel members may be an appropriate distance such that guardrail beam 204 is inserted into the channel created by extruder 210. For example, where guardrail beam 204 comprises a 12-gauge W-beam rail element having a vertical dimension of approximately 12.25 inches, the distance between the top of channel member and the bottom of channel may be approximately 14 inches, in a particular embodiment.

Front striking plate 209 may be secured by welding to extruder 210 of end treatment 200. Front striking plate 209 may be vertically elongated, in particular embodiments. Thus, front striking plate 209 may extend both above and below extruder 210 to permit front striking plate 209 to be easily engaged by either the high bumper of trucks, SUV's, and other taller vehicles and the low set bumpers of smaller cars impacting in a frontal manner. Front striking plate 209 is also positioned so as to engage the vehicle frame or rocker panel to reduce vehicle intrusion when the upstream end of end treatment 200 is impacted by a vehicle in a sideways manner.

During an end-on or oblique end-on collision of a vehicle with front striking plate 209, extruder 210 may be displaced in a downstream direction and downstream portions of guardrail beam element 204 may be forced into the displaced extruder 210. During such a collision, extruder 210 functions as a guide to guide guardrail beam element 204 into flattening portion 212, which includes a narrowing throat 213. Extruder may include guides that prevent shaving of the W-beam guardrail element 204 by ends of extruder 210 as extruder 210 moves along the length of the guardrail beam element 204 during a collision. The guides may accommodate any irregularities or bumps in guardrail beam element 204 to ensure proper feeding of guardrail beam element 204 into flattening portion 212.

As extruder 210 of end treatment 200 moves along guardrail beam element 204 and downstream portions of guardrail beam element 204 are forced into flattening portion 212 through narrowing throat 213, guardrail beam element 204 is flattened vertically. Portions of guardrail beam element 204 exiting the upstream end of flattening portion 212 are flattened into what may appear to be two vertically stacked plates, in a particular embodiment. As this flattening process occurs, substantial energy is dissipated slowing the impacting vehicle.

Figure 2D:
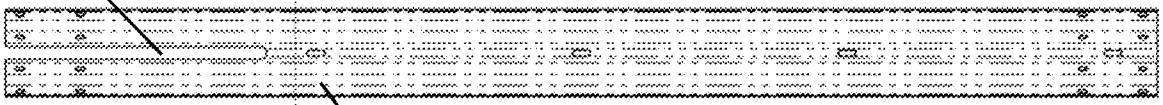

To aid in initial flattening of guardrail beam element 204 and to aid in the coupling of guardrail beam 204 to tension cable 206, a terminal end of guardrail beam element 204 may be slotted as shown in FIG. 2D. Specifically, the guardrail beam 204 includes a slotted zone at the upstream end of the terminal portion of guardrail beam element 200. In a particular embodiment, slotted zone 202 comprises a series of slots longitudinally disposed in the guardrail beam element 200. The use of three slots has proven effective in testing models of guardrails constructed similar to guardrail safety system 100.

Slotted zone 214 may initiate at a terminal end of guardrail beam 204 and extend a desired distance downstream. The horizontal length of slotted zone 214 may vary depending on the horizontal length of end treatment 200. It may be desirable for slotted zone 214 to include the portion of guardrail beam 204 that is coupled to paddle 208 and the portion of guardrail beam 204 that traverses through flattening portion 212. Generally, slotted zone 214 may extend from the terminal, upstream end of guardrail beam element 200 to some distance between the first and second support posts 104.

Figure 2E:
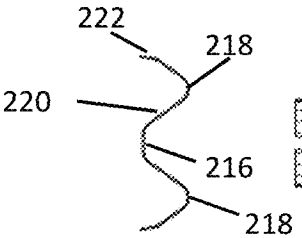
Figures 3A, 3B, 3C, 3D, 3E:
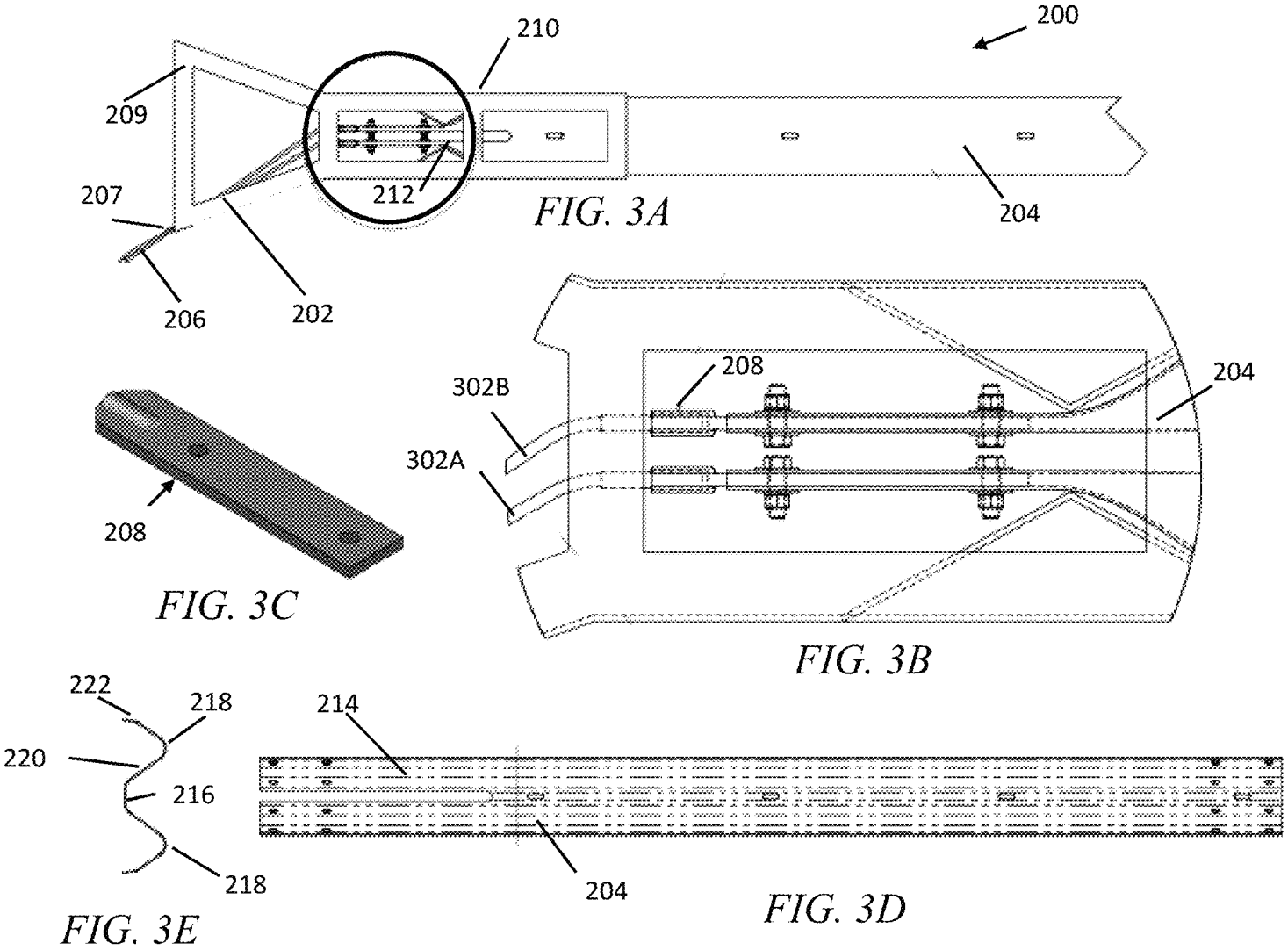
FIGS. 3A, 3B, 3C, 3D, and 3E illustrate various views of a tension end treatment having a multiple round cable leaders, according to particular embodiments.

The placement of one or more slots in slotted zone 214, according to a particular embodiment, may be better understood with reference to the cross- section for a typical W-beam guardrail 204 as also shown in FIG. 2E. A valley 216 is positioned between upper and lower peaks 218 and is formed at the intersections of inclined web portions 220. Edge members 222 laterally out lie each peak 218. In the depicted embodiment, a single slot is placed at the valley 216. In another embodiment, multiple slots may be used and the slots may be placed proximate each peak 218 and the valley 216. Thus, for example, first and second slots may be placed in the first and second peaks 218, respectively, and a third slot may be placed in valley 216.

A slot should be of a size sufficient to enhance the ability of the terminal end of guardrail beam 204 to be coupled to paddle 208 and to be flattened. For example, in one particular embodiment, a slot may be approximately 0.5 inches, as measured vertically. Thus, in a particular embodiment, the slot may have a width on the order of 0.5 inches and extend approximately 81-82 inches. Alternatively, an effective size for the slot has been found to be approximately 0.75 inches, as measured vertically. Thus, the slot may have a width on the order of approximately 0.75 inches and extend approximately 81-82 inches. The provided dimensions are for example purposes only, however. Any number of slots and any size of slot may be used for the one or more slots to enhance the ability of guardrail beam 204 to be coupled to tension cable 206.

While guardrail beam 204 may include W-beam rail elements, it is generally recognized that the illustrated guardrail beam 204 is merely an example of a beam that may be used in a guardrail system. Guardrail beams 204 or portions of guardrail beams 204 may include conventional W-beam guardrails, thrie beam guardrails, box beams, wire ropes, or other structural members suitable for redirecting an errant vehicle upon impact. It is also recognized that the configuration and dimensions of any of the above-described elements within guardrail system 100 may vary as desired.

Returning to FIGS. 1 and 2, following the initial end-on impact of a vehicle with end treatment 200 and the initiation of the displacement of end treatment 200 in a downstream direction, the impacting vehicle and end treatment 200 may engage one or more support posts 104. Where the support posts 104 comprises steel yielding support posts that are modified to release guardrail beam 102 as they are impacted and bent toward the ground. Thus, support posts 104 that are impacted during the collision may be displaced, in certain embodiments, such that they do not pose a hazard to the impacting vehicle. Although guardrail beam 102 may be released from impacted support posts 104, portions of guardrail beam 102 downstream from the impact may remain in substantially their original position relative to the ground's surface. Further, because guardrail beam 102 remains coupled to tension cable 206 during an end-on or re-directive impact, guardrail beam 102 remains in tension. This extends the range of acceptable performance of guardrail safety system 100.

The tension in guardrail beam 102 may also be retained in this manner when guardrail system 100 is subject to a redirective impact in the length of need portion of guardrail system 100. For example, when an impacting vehicle traveling in a direction substantially parallel to the downstream direction of guardrail system 100 leaves the roadway and impacts guardrail system 100, any support posts 104 impacted by the vehicle may operate to release guardrail beam 102 as they are impacted. Modified support posts 104 may be bent toward the ground such that the support posts 104 are displaced and do not pose a hazard to the impacting vehicle. Because the tension in guardrail beam 102 is maintained, guardrail beam element 102 continues to operate to redirect the vehicle back onto the roadway even after one or more support posts are released from guardrail beam element 102.

FIGS. 3A, 3B, 3C, 3D, and 3E illustrate various views of a tension end treatment 300 having a multiple round cable leaders, according to a particular embodiment. Many features of end treatment 300 may be similar to the features described above with regard to end treatment 200. Accordingly, common system elements have been labeled using common reference numerals. In contrast to end treatment 200, however, end treatment 300 depicts the system being held in tension by two cable leaders 302A and 302B rather than one. In still another embodiment, a flattened battery cable leader may be used in place of a round cable. As still a further possible modification, though FIGS. 2A-2E and FIGS. 3A-3E depict the one or more tension cables as exiting the end treatment through a snout through the head, other embodiments may include attaching the cable external to the head. Additionally, the one or more tension cables may be attached to the guardrail beam directly and run for some distance longitudinally along the length of the guardrail beam.

Figure 4A:
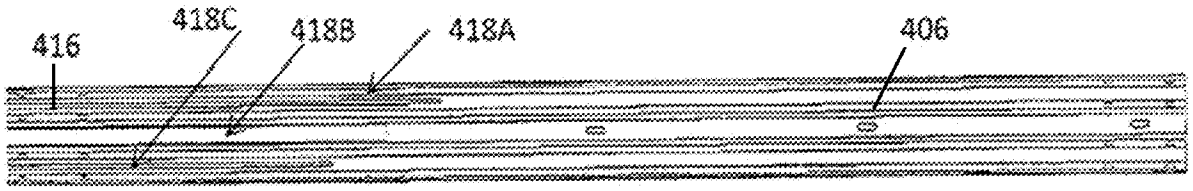
FIGS. 4A and 4B illustrate various side views of an exemplary embodiment of an end treatment having a constant slope snout, according to particular embodiments.
Figure 4B:
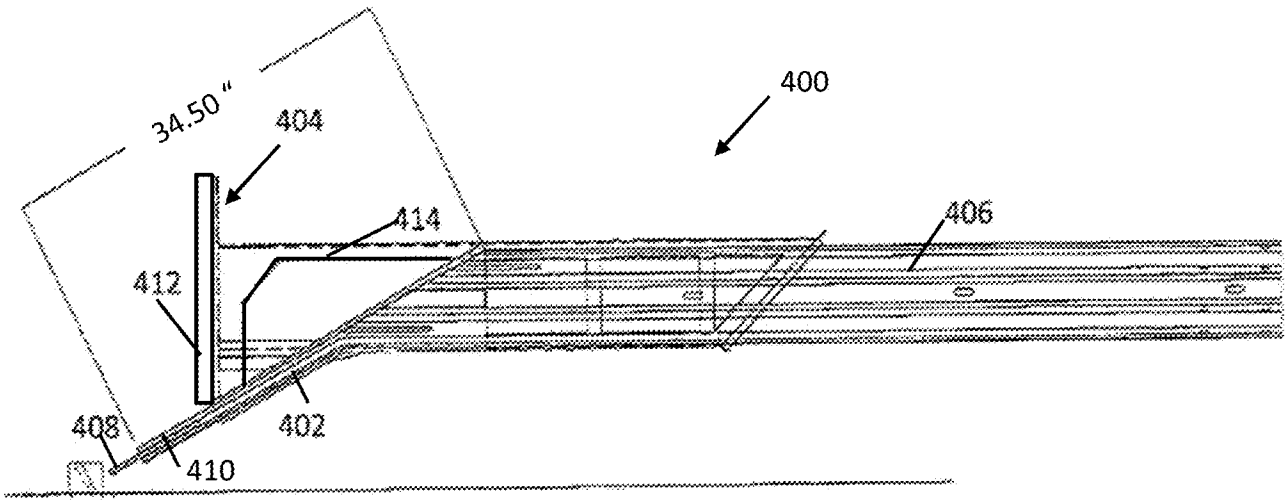

FIG. 4 illustrates various side views of an exemplary embodiment of an end treatment 400 having a constant slope snout 402, according to particular embodiments. The tensioned end treatment includes a head 404 that couples to a slotted guardrail beam 406 Guardrail beam 406 is held in tension by tension cable 408, which exits constant slope snout 402 approximate to the ground. The coupling between tension cable 408 and guardrail beam 406 is affected by a paddle 410. The coupling of guardrail beam 406 to tension cable 408 enables guardrail beam 406 to remain secured in tension even after either of an end-on or re-directive impact by a vehicle leaving roadway 101. However, the components effecting the tensile coupling enables the tension in guardrail beam 406 to be released when the system is impacted in the reverse direction near the terminal end. The releasing of tension in the guardrail element for reverse direction impacts prevents vehicle instability and excessive deceleration.

Head 404 includes a front striking plate 412 coupled to an extruder 414. Extruder 414 surrounds the upstream portion of guardrail beam 406. In one embodiment, extruder 414 may be made up of an upper, U-shaped channel member and a lower, U-shaped channel member, which are secured in a spaced relation to one another by strap plates. The vertical distance between the channel members may be an appropriate distance such that guardrail beam 406 is inserted into the channel created by extruder 414. For example, where guardrail beam 406 comprises a 12-gauge W-beam rail element having a vertical dimension of approximately 12.25 inches, the distance between the top of channel member and the bottom of channel may be approximately 14 inches, in a particular embodiment.

Figure 5:
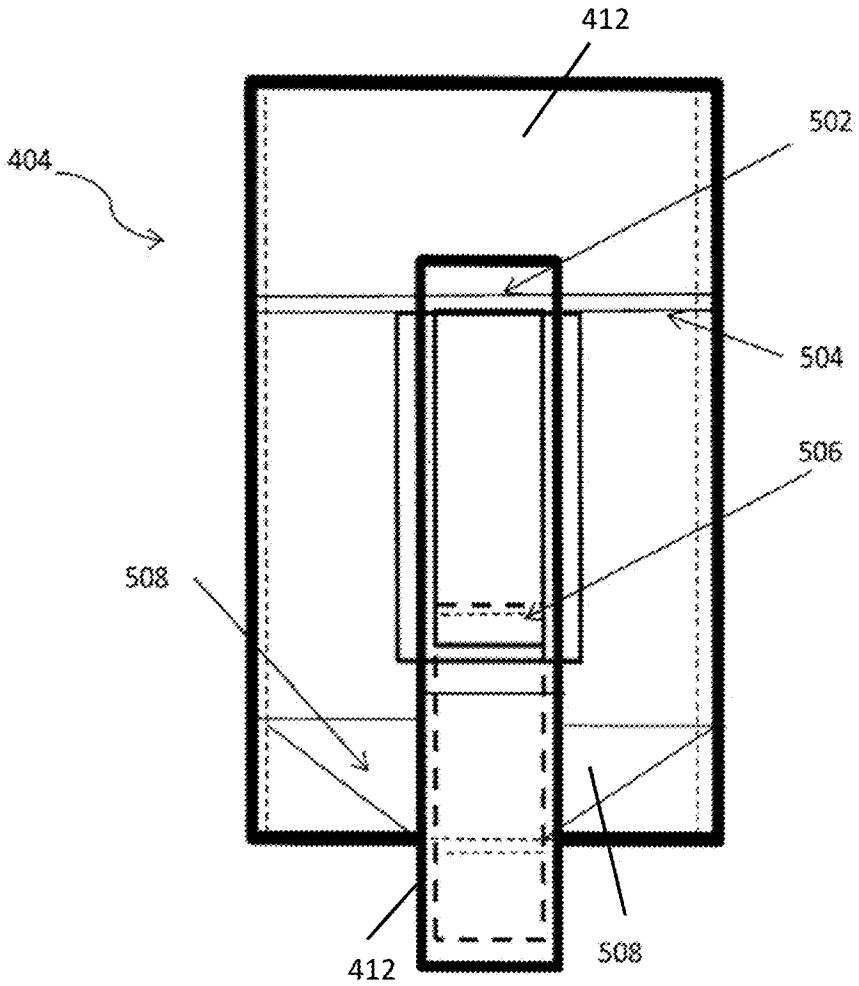
FIG. 5 illustrates a particular bracing scheme including to top channel bracing, triangular bracing, and angle bracing, according to a particular embodiment.
Figure 6A:
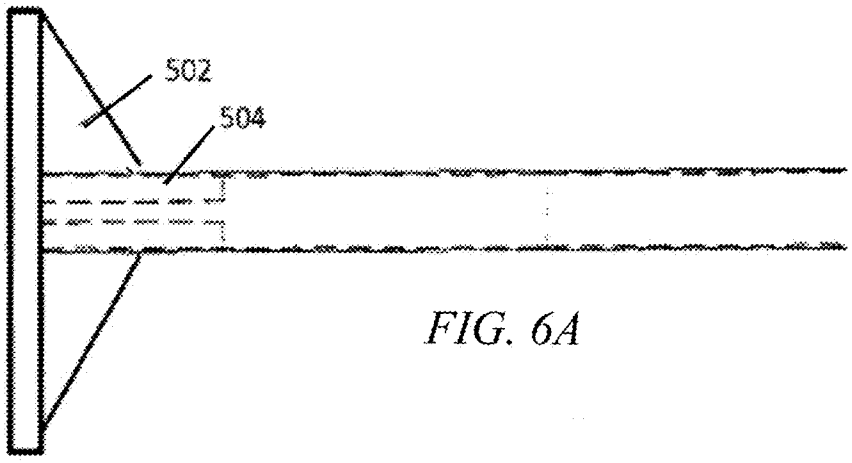
FIGS. 6A and 6B illustrate side and top perspective views of the end treatment of FIGS. 4A and 4B implemented using the bracing scheme of FIG. 5, according to a particular embodiment.
Figure 6B:
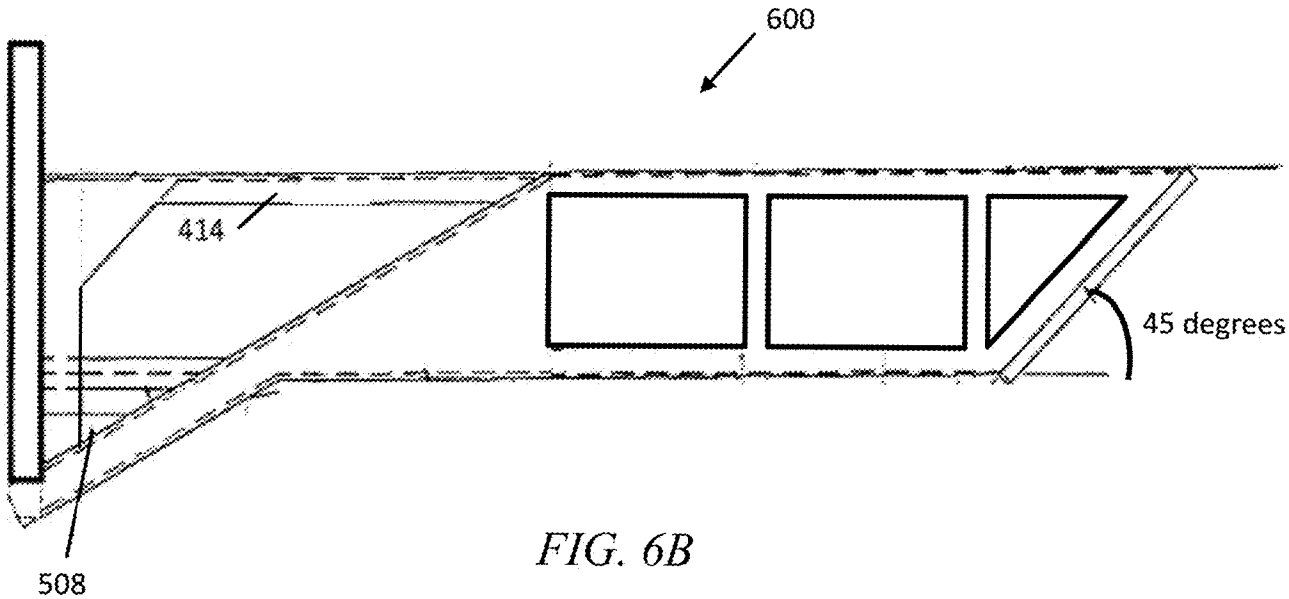

FIG. 5 illustrates a particular bracing scheme including to top channel bracing, triangular bracing, and angle bracing, in a particular embodiment. As depicted, the bracing scheme includes top channel bracing 502 near the top of extruder 414. Top channel bracing 502 may be approximately ⅜" thick in a particular embodiment. First triangular bracing 504 is also used proximate the top of extruder 414. Angle bracing 506 is placed near the bottom of extruder 414 and throat 402. In a particular embodiment, the angle bracing 506 may include 2"×2"×¼" bracing. Second triangle bracing 508 is depicted proximate throat 402. FIGS. 6A and 6B illustrate side and top perspective views of an implementation 600 of the end treatment of FIGS. 4A-4B incorporating the bracing scheme of FIG. 5, according to a particular embodiment.

Returning to FIG. 4B, front striking plate 412 may be secured by welding to extruder 414 of end treatment 400. Front striking plate 412 may be vertically elongated, in particular embodiments. Thus, front striking plate 412 may extend both above and below extruder 414 to permit front striking plate 412 to be easily engaged by either the high bumper of trucks, SUV's, and other taller vehicles and the low set bumpers of smaller cars impacting in a frontal manner. Front striking plate 412 is also positioned so as to engage the vehicle frame or rocker panel to reduce vehicle intrusion when the upstream end of end treatment 400 is impacted by a vehicle in a sideways manner.

During an end-on or oblique end-on collision of a vehicle with front striking plate 412, extruder 414 may be displaced in a downstream direction and downstream portions of guardrail beam element 416 may be forced into the displaced extruder 414. Extruder 414 may include guides that prevent shaving of the W-beam guardrail element 406 by ends of extruder 414 as extruder 414 moves along the length of the guardrail beam element 406 during a collision. The guides may accommodate any irregularities or bumps in guardrail beam element 406 to ensure proper feeding of guardrail beam element 406 into constant slope snout 402.

As extruder 414 of end treatment 400 moves along guardrail beam element 406 and downstream portions of guardrail beam element 406 are forced into constant slope snout 402, guardrail beam element 406 is flattened vertically. Portions of guardrail beam element 406 exiting the upstream end of constant slope snout 402 are flattened into what may appear to be two vertically stacked plates. As this flattening process occurs, substantial energy is dissipated slowing the impacting vehicle.

To aid in initial flattening of guardrail beam element 406 and to aid in the coupling of guardrail beam 406 to tension cable 408, a terminal end of guardrail beam element 406 may be slotted in a manner similar to that described above with regard to FIG. 2D. Specifically, the guardrail beam 406 includes a slotted zone at the upstream end of the terminal portion of guardrail beam element 406. In a particular embodiment, slotted zone 416 comprises a series of slots longitudinally disposed in the guardrail beam element 406. The use of three slots has proven effective in testing models of guardrails constructed similar to guardrail safety system 100. Thus, in the particular depicted embodiment, slotted zone 416 includes three slots 418A-C. A first slot 418A that extends a first distance from the upstream end of guardrail beam 406. For example, first slot 418A is shown extending approximately sixty inches from the upstream end of guardrail beam 406. A second slot 418B is shown extending approximately 52.5 inches from the upstream end of guardrail beam 406, and a third slot 418C is shown extending approximately 45 inches from the upstream end of guardrail beam 406. The placement of one or more slots in slotted zone 416, according to a particular embodiment, may be similar to that described above with regard to FIG. 2D.

Slotted zone 416 may initiate at a terminal end of guardrail beam 406 and extend a desired distance downstream. The horizontal length of slotted zone 416 may vary depending on the horizontal length of end treatment 400. It may be desirable for slotted zone 416 to include the portion of guardrail beam 406 that is coupled to paddle 410 and the portion of guardrail beam 406 that traverses through constant slope snout 402. Generally, slotted zone 416 may extend from the terminal, upstream end of guardrail beam element 406 to some distance between the first support post 420 and a second support post (not depicted).

While guardrail beam 406 may include W-beam rail elements, it is generally recognized that the illustrated guardrail beam 406 is merely an example of a beam that may be used in a guardrail system. Guardrail beams 406 or portions of guardrail beams 406 may include conventional W-beam guardrails, thrie beam guardrails, box beams, wire ropes, or other structural members suitable for redirecting an errant vehicle upon impact. It is also recognized that the configuration and dimensions of any of the above-described elements within guardrail system 100 may vary as desired.

As depicted, guardbeam rail 406 feeds into a downstream end of constant slope snout 402. Conversely, tension cable 408 feeds through an upstream end of constant slope snout 402 at a downstream end of end treatment 400. Further, constant slope snout 402 extends from the upstream end and slopes toward the ground. Specifically, constant slope snout 402 is configured to transition guardrail beam 406 from a height above the ground level that is appropriate for redirecting an impacting vehicle (31 inches, in a particular embodiment) to ground level.

Figure 7:
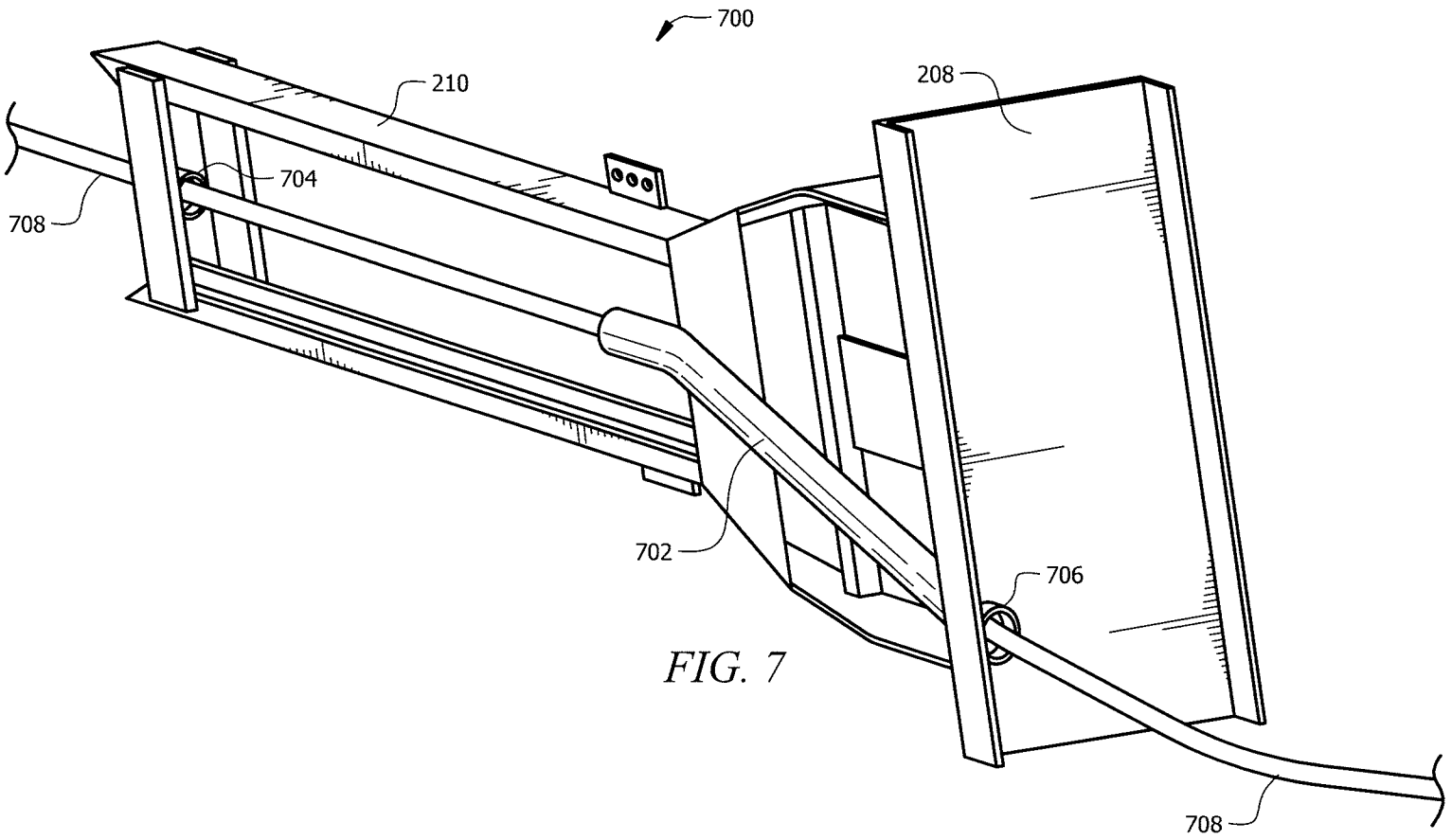
FIG. 7 illustrates side perspective view of an exemplary embodiment of an end treatment having a cable guide, according to particular embodiments.

FIG. 7 illustrates an exemplary embodiment of an end treatment 700 having a cable guide 702, according to particular embodiments. Specifically, cable guide 702 may comprise a retrofit component that may be added to existing and in use end terminal systems. Many features of end treatment 700 may be similar to the features described above with regard to end treatment 200. Accordingly, common system elements have been labeled using common reference numerals.

According to certain embodiments, end treatment 700 includes a terminal portion of a guardrail beam 102 comprising a downstream end and upstream end. At least a portion of the upstream end feeds into extruder 210. In certain embodiments, a tension cable 708 is coupled to a terminal support post using any suitable technique described above. Tension cable 708 feeds through cable outlet 706 at an upstream end of extruder 210. In a particular embodiment, for example, tension cable 708 may feed through cable outlet 706 of striking plate 208. Tension cable 708 then traverses through cable guide 702 from an upstream end to a downstream end of extruder 210.

In the illustrated embodiment, cable guide 702 comprises a tube through which the tension cable 708 is threaded. The cable guide 702 may be configured to transition the tension cable from a first height above ground level to a second height that is lower than the first. Cable guide may be uniformly sloped from the first height to the second height. At a downstream end of extruder, tension cable 708 may be threaded through cable 704 to exit the extruder 210.

In a particular embodiment, cable guide 702 may include two sections through which tension cable 708 is disposed. The first portion is a downstream portion that is substantially horizontal and runs substantially parallel to extruder 210 and guardrail beam 102. A second portion extends from the upstream end of the first portion and slopes toward the ground. In a particular embodiment, the second portion may be uniformly sloped from the first height to the second height. Specifically, the second portion is configured to transition tension cable 708 from a first height above the ground level that is appropriate for redirecting an impacting vehicle (31 inches, in a particular embodiment) to an outlet 706 of extruder 210 that is lower than the first height.

A upstream end of tension cable 708 is then anchored to a terminal support post, similar to the terminal support post 106 described with regard to FIG. 1. To maintain the system in tension, a downstream end of the tension cable may be coupled to a terminal support post and an upstream end of the tension cable may be coupled to a support post positioned downstream from the extruder 210.

Figure 8:
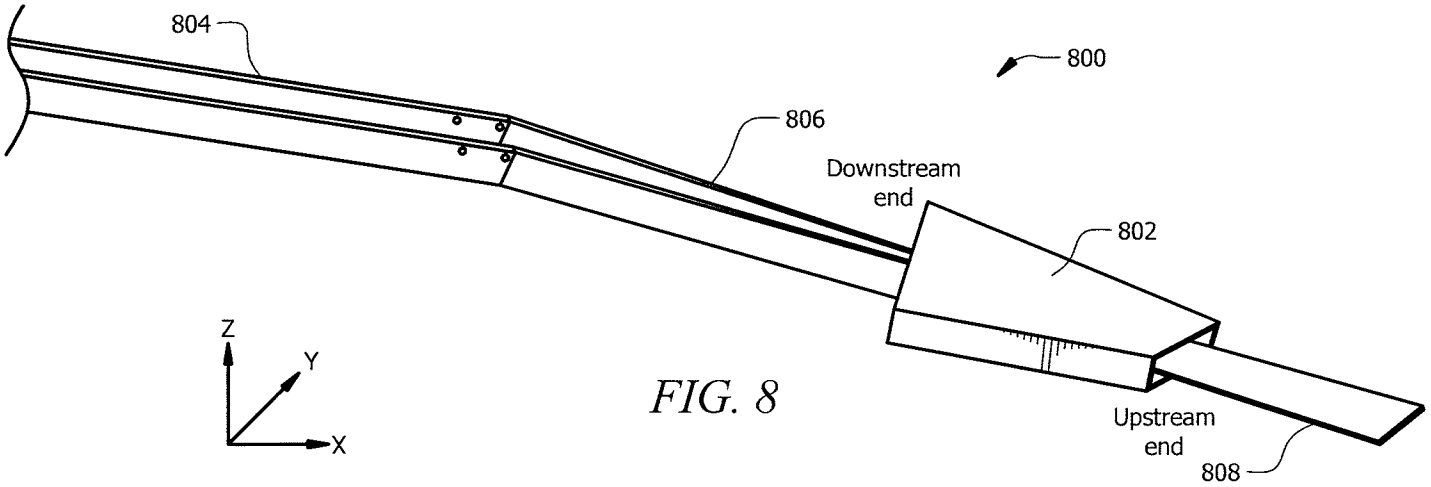
FIG. 8 illustrates a side view of a sliding extruder terminal, according to a particular embodiment.

FIG. 8 illustrates an exemplary sliding extruder terminal system 800, according to a particular embodiment. As described above, certain prior terminal systems may share a common limitation, which is the inability to sustain tension in the rail system once the anchor cable is disengaged. The only system known to carry tension in the turned-down guardrail system is not approved for installation on national highway systems due to the system's role in destabilizing a vehicle (i.e., rollover).

As illustrated in FIG. 8, however, sliding extruder terminal system 800 includes a modified extruder terminal throat 802, which accepts a guardrail beam and twists the guardrail beam from a substantially vertical position to a substantially horizontal position. According to particular embodiments, extruder terminal system 800 includes throat 802 having an inlet at a downstream end that is wider than the outlet at the upstream end of the throat 802. In operation, throat 802 converts the impacting vehicle kinetic energy into internal energy by flattening the rail. In a particular embodiment, throat 802 may flatten a W-beam guardrail beam into a flat plate. Thus, extruder terminal system 800 includes a guardrail beam having a substantially horizontal portion 804, a pre-twisted portion 806, and a flattened end portion 808. The upstream end of flattened end portion 804 may be anchored to a terminal anchor post at ground level or in any other suitable anchoring system.

The twister may help maintain the flat portion of the rail on a horizontal traversable profile. In certain embodiments, sliding ET 800 may consist of two main components: the slider top 810 and slider bottom 812. The slider top 810 and slider bottom 812 may be joined during construction using bolting and/or clamping fastening techniques.

Figure 9A:
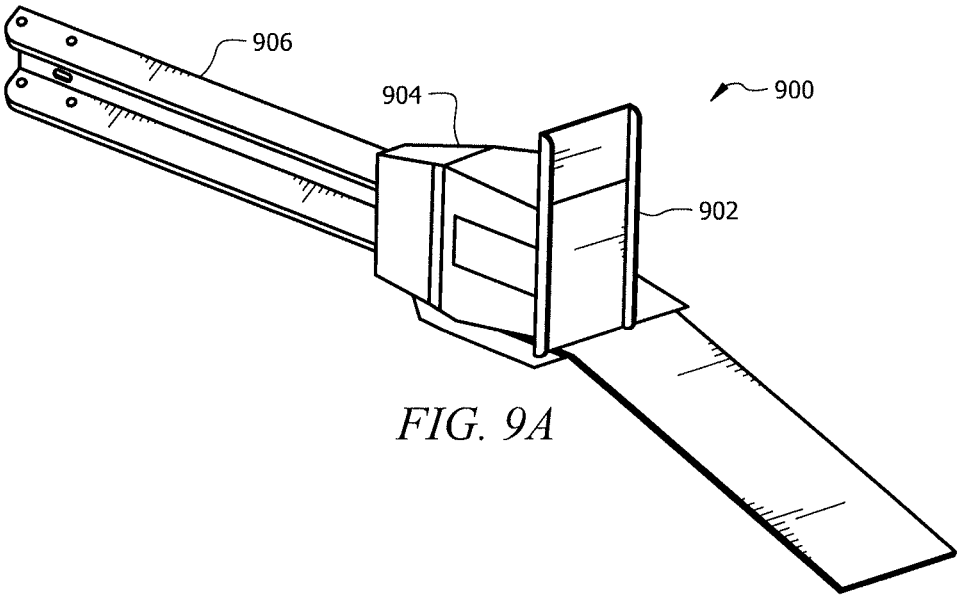
FIGS. 9A, 9B, and 9C illustrate various views of a sliding extruder terminal, according to another embodiment.
Figure 9B:
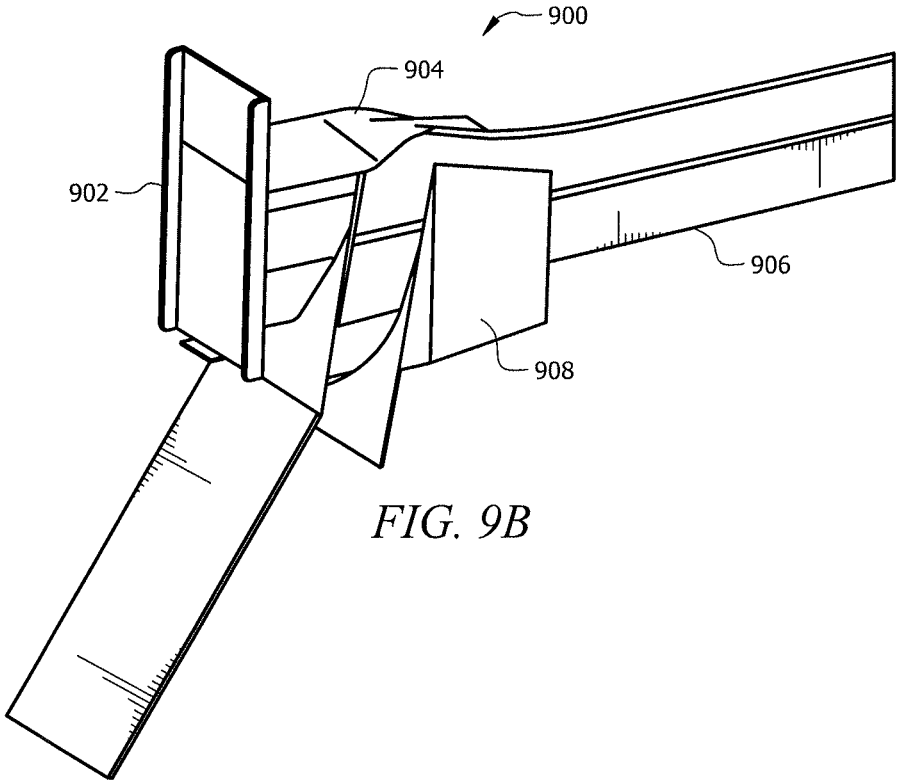
Figure 9C:
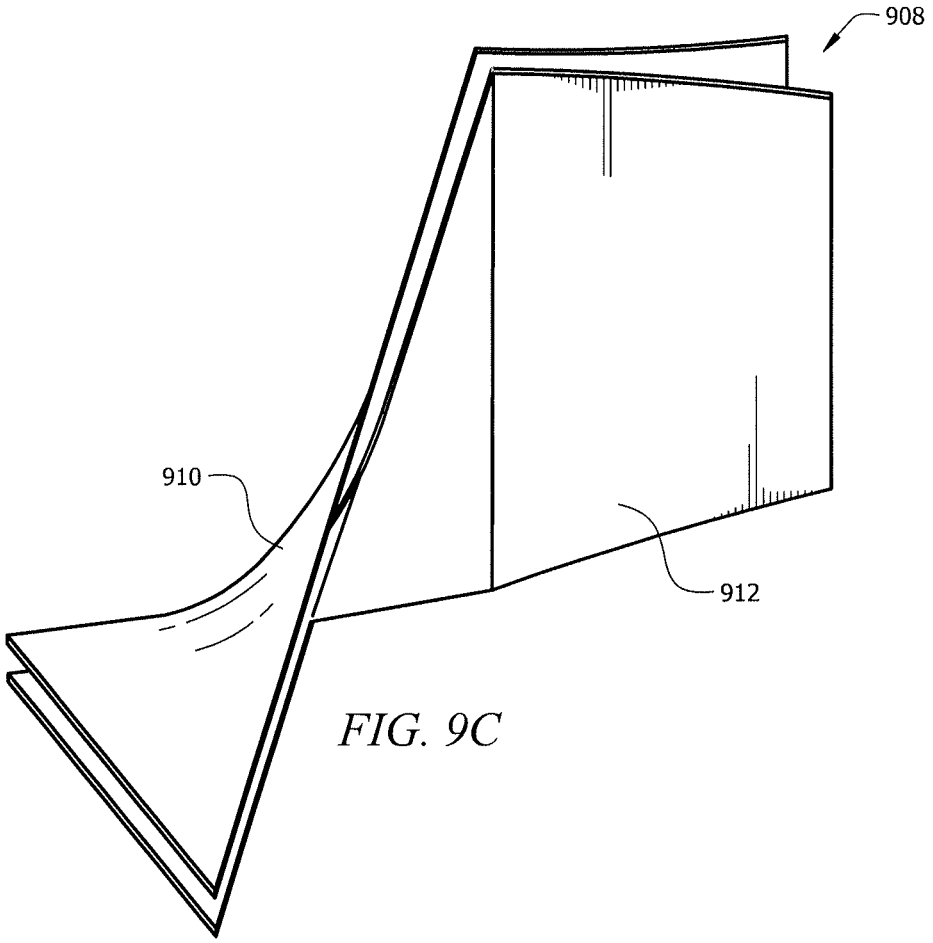

FIGS. 9A-C illustrate various views of a sliding extruder terminal 900, according to another embodiment. Specifically, FIG. 9A is an oblique view of sliding extruder terminal system 900, according to a particular embodiment. Sliding extruder terminal system 900 includes front portion 902 and back portion 904, which may be joined at the time of installation through some connection details such as bolting. In particular embodiments, an undeformed portion of guardrail beam 906 and sliding extruder terminal 900 are at the same height as that of a standard w-beam when installed adjacent a roadway.

In a particular embodiment, sliding extruder terminal 900's includes a throat twister 908, which takes the standard w-beam shape and flattens it as the guardrail beam 906 moves through the throat twister 908. Throat twister 908 also simultaneously twists guardrail beam 906 toward the ground. The profile of the w-beam 906 before, thru and after engaging sliding extruder terminal 900 is shown in FIG. 9B. FIG. 9C illustrates the components of throat twister 908 in more detail. As depicted, in a particular embodiment, throat twister 908 includes a first plate 910 and a second plate 912, which are disposed proximate one another such that when guardrail beam 906 moves between first and second plates 910 and 912 guardrail beam 906 is flattened into a substantially flat plate.

Figure 10:
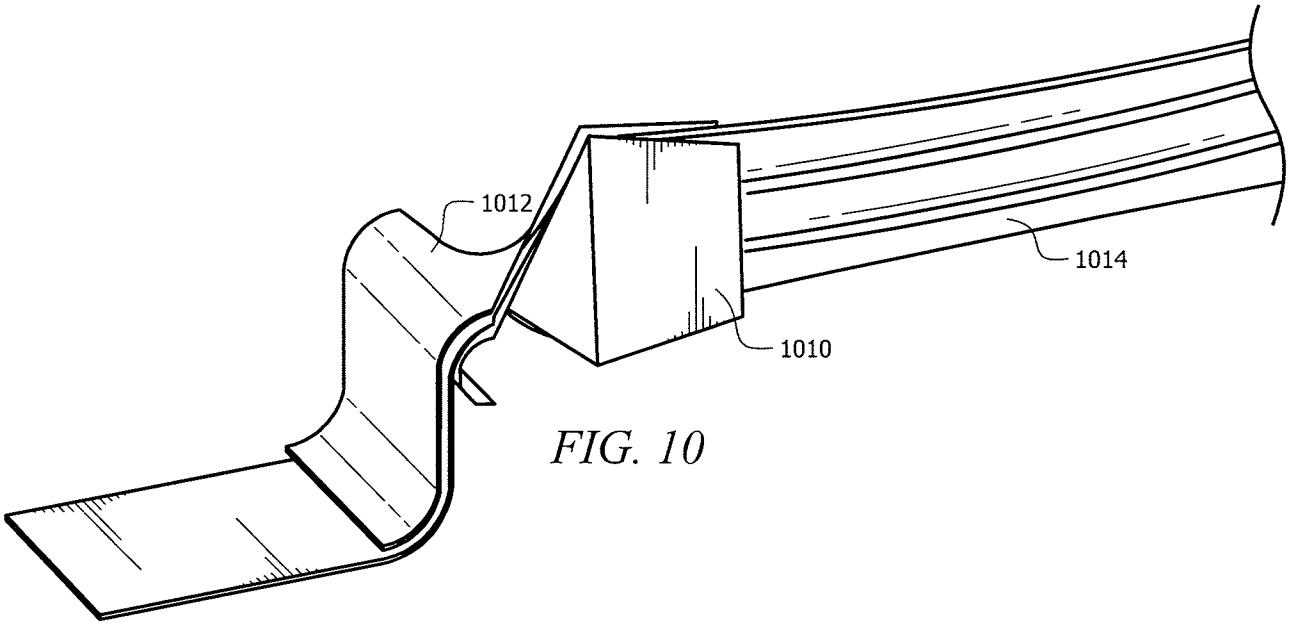
FIG. 10 illustrates a side perspective view of a sliding twister extruder terminal, according to a particular embodiment.

FIG. 10 illustrates a sliding twister extruder terminal 1000, according to a particular embodiment. Similar to the extruder terminal system of FIG. 9, sliding twister extruder terminal system 1000 includes a first plate 1010 and a second plate 1012, which are positioned proximate one another to result in the flattening of guard rail beam 906 into a substantially flat plate. as extruder terminal is moved along the guard rail beam in a collision. More specifically, sliding twister extruder terminal 1000 receives the standard w-beam guardrail 1014 at a downstream end and flattens guardrail beam 1014 as guardrail beam 1014 moves through the throat including the first and second plates 1010 and 1012. Sliding twister extruder terminal 1000 also twists guardrail beam 1014 toward the ground. In particular embodiments, sliding twister extruder terminal 1000, squeezes guardrail beam 1014 into a substantially flat plate while simultaneously twisting guardrail beam 1014 by 90 degrees. Extruder terminal 1000 then turns the guardrail beam around 90 degrees to reach the ground and finally turns it around 90 degrees again to run parallel to the ground. Tension is accomplished in guardrail beam 1014 by fixing the upstream end of the guardrail beam 1014 to the ground.

Figure 11:
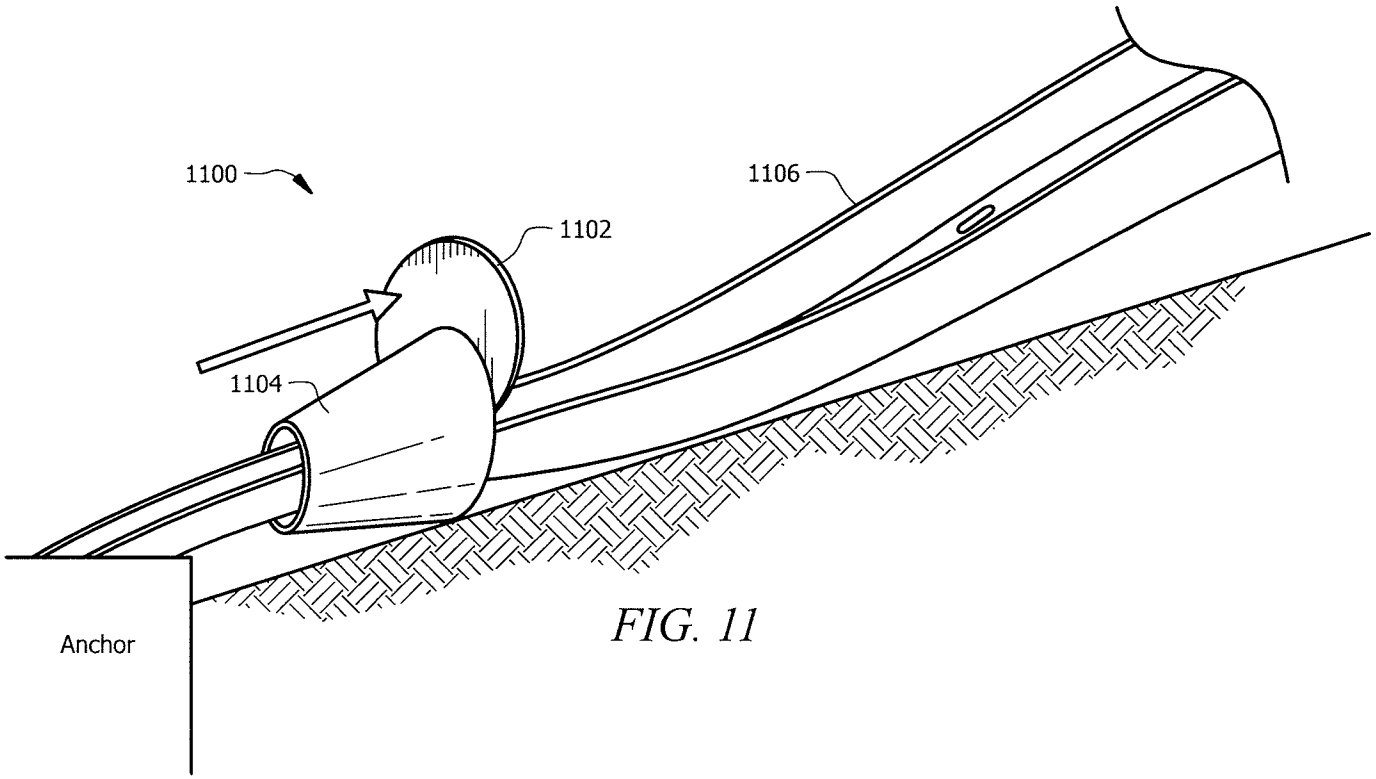
FIG. 11 illustrates guardrail end treatment having a cone-shaped throat for receiving a terminal portion of a guardrail beam, according to a particular embodiment.

FIG. 11 illustrates guardrail end treatment 1100 having a striking plate 1102 and a cone-shaped throat 1104 for receiving a terminal portion of a guardrail beam 1106, according to a particular embodiment. The guardrail end treatment 1100 may suitable for turned down guardrail end treatment. In a particular embodiment, for example, guardrail end treatment 1100 may be appropriate for incorporation into the terminal system known as the Texas Twist.

In a particular embodiment, the terminal portion of a guardrail beam 1106 includes a downstream end and upstream end. The cone-shaped throat 1104 may be configured to receive at least a portion of the guardrail beam 1106. As depicted, cone-shaped throat 1104 may form a narrowing channel through which at least a portion of the guardrail beam 1106 is threaded. In a particular embodiment, a diameter of a downstream end of the cone-shaped throat 1104 may be greater than a diameter of an upstream end of the cone-shaped throat 1104. As a result, cone-shaped throat 1104 may operate to flatten guardrail beam 1106 in response to a collision with a vehicle, such as when the vehicle results in the displacement of cone-shaped throat 1104 in a downstream direction along the terminal portion of the guardrail beam 1106.

In a particular embodiment, the guardrail beam 1106 comprises a w-beam member such as that described above. Additionally, guardrail beam 1106 may be configured with at least one slotted zone formed in an upstream end of the w-beam member 1106. Cone-shaped throat 1104 may be configured to flatten the slotted w-beam member into a plurality of stacked plates.

In certain embodiments, the guardrail end treatment 1100 may be located where the guardrail transitions from vertical at a support post such as support post 104 to horizontal at the grade. In a particular embodiment, the striking plate 1102 comprises a rounded vertical plate that serves to catch the errant vehicle and push/slide a cone-shaped throat 1104 downstream along the guardrail beam 1106. In certain example implementations, the depicted embodiment may be used as a retrofit to an existing guardrail end treatment system.

Technical advantages of particular embodiments of the present invention include a guardrail end treatment that dissipates impact energy for deceleration of the impacting vehicle. Another advantage may be that a tensile and resistive coupling may be provided for connecting an end of the W-beam guardrail element to a terminal support post. The components of the system that provide the tensile connection of the guardrail beam to the terminal support post may enable the guardrail beam to remain secured after an end-on or re-directive impact. Thus, the system may remain in tension during both types of impacts. Still another advantage may be that the tension is released when the system is impacted in the reverse direction near the terminal end, however. The releasing of tension in the guardrail element for reverse direction impacts prevents vehicle instability and excessive deceleration.

Although the present invention has been described by several embodiments, various changes and modifications may be suggested to one skilled in the art. It is intended that the present invention encompass such changes and modifications as fall within the scope of the present appended claims. For example, the features described above may be used independently and/or in combination with each other or other design modifications.

What is claimed is:

1. An end treatment for a guardrail safety system comprising:

a terminal portion of a guardrail beam comprising a downstream end and an upstream end;

a first tension cable having a downstream end and an upstream end, the upstream end being coupled to a terminal support post installed adjacent the roadway at an upstream end of the end treatment, the downstream end of the first tension cable being coupled to a support post;

an extruder configured to receive at least a portion of the terminal portion of the guardrail, the extruder configured to be displaced in a downstream direction in response to a collision with a vehicle moving in the downstream direction;

a striking plate at an upstream end of the extruder, the striking plate extending above and below the extruder, the striking plate being configured with an outlet through which the first tension cable passes, the outlet being at a location above ground level;

a cable guide coupled to the extruder, the cable guide comprising a tube through which the first tension cable passes, the cable guide configured to transition the tension cable from a first height above the ground level to a second height that is lower than the first height and proximate the location of the outlet in the striking plate at the location above the ground level.

2. The end treatment of claim 1, wherein the cable guide comprises:

a first portion that is horizontal and runs parallel to a length of the extruder; and a second portion that extends from an upstream end of the first portion and slopes toward the ground, wherein the second portion is configured to transition the tension cable from the first height to the second height that is lower than the first height.

3. The end treatment of claim 1, wherein at least a portion of the cable guide is uniformly sloped from the first height to the second height.

4. The end treatment of claim 1, wherein the extruder comprises a cable eye at a downstream end of the extruder, the tension cable passing through the cable eye.

5. An end treatment for a guardrail safety system comprising:

a terminal portion of a guardrail beam comprising a downstream end and an upstream end;

a first tension cable coupled to the upstream end of the terminal portion of the guardrail beam;

a second tension cable having a downstream end and an upstream end, the downstream end of the first tension cable being coupled to a support post;

an extruder configured to receive at least a portion of the guardrail beam and at least a portion of the first tension cable, the extruder comprising a narrowing throat providing a channel in which the at least a portion of the guardrail beam is disposed, wherein the narrowing throat is configured to flatten the guardrail beam in response to a. collision with a vehicle moving the extruder in a downstream direction along the guardrail beam;

a striking plate at an upstream end of the extruder, the striking plate extending above and below the extruder, the striking plate being configured with an outlet through which the first tension cable passes, the outlet being at a location above ground level;

a cable guide coupled to the extruder, the cable guide comprising a tube through which the first tension cable passes, the cable guide configured to transition the tension cable from a first height above the ground level to a second height that is lower than the first height and proximate the location of the outlet in the striking plate at the location above the ground level; and a terminal support post installed adjacent the roadway at the upstream end of the end treatment, the terminal support post being coupled to an upstream end of the first tension cable and the upstream end of the third tension cable proximate ground level, and wherein the guardrail beam comprises a w-beam member, Wherein the guardrail beam includes a plurality of slotted zones formed in an upstream end of the w-beam member, wherein the first tension cable is coupled to the terminal portion of the guardrail beam by a first paddle configured to maintain the tension cable in tension during an end-on or re-directive impact by a vehicle leaving a roadway, wherein the second tension cable is coupled to the terminal portion of the guardrail beam by a second paddle configured to maintain the tension cable in tension during the end-on or re-directive impact by the vehicle leaving the roadway, and wherein the narrowing throat is configured to flatten the w-beam member into a plurality of stacked plates.

* * * * *